US005241519A

United States Patent [19]

Monahan et al.

[11] Patent Number: 5,241,519

[45] Date of Patent: Aug. 31, 1993

[54] HYDROPHONE ASSEMBLY WITH VIBRATIONS ISOLATED TRANSDUCER ELEMENTS

[75] Inventors: Patrick Monahan, Gales Ferry; George Battista, Waterford, both of Conn.

[73] Assignee: The United States of America as represented by the Secretary of the Navy, Washington, D.C.

[21] Appl. No.: 917,648

[22] Filed: Jul. 23, 1992

[51] Int. Cl.[5] ..... H04R 17/00

[52] U.S. Cl. ..... 367/154; 367/173; 367/20; 310/337

[58] Field of Search ..... 367/20, 154, 169, 173, 367/176; 264/DIG. 77, 272.14, 272.16; 310/334, 337, 340

[56] References Cited

U.S. PATENT DOCUMENTS

| | | | |
|---|---|---|---|
| 2,923,916 | 2/1960 | Woodworth | 367/20 |
| 3,354,984 | 11/1967 | Pavey, Jr. | 367/20 |
| 3,372,370 | 3/1968 | Cyr | 367/176 |
| 3,489,997 | 1/1970 | Massa | 367/154 |
| 4,782,470 | 11/1988 | Poturnicki, Jr. et al. | 367/157 |
| 4,884,249 | 11/1989 | Snook | 367/154 |
| 4,926,399 | 5/1990 | Hickman | 367/173 |

*Primary Examiner*—J. Woodrow Eldred
*Attorney, Agent, or Firm*—Michael J. McGowan; Prithvi C. Lall; Michael F. Oglo

[57] ABSTRACT

Hydrophone transducer elements are mechanically isolated from one another in vibration by suspending them in a urethane matrix molded into a cylindrical shape. A metal ring is mechanically locked in an annular slot defined by the cylindrical shaped matrix. The ring is used to mechanically support the assembly for towing. The transducer elements are electrically connected to one another and to an electrical cable independently of this mechanical support.

4 Claims, 1 Drawing Sheet

HYDROPHONE ASSEMBLY WITH VIBRATIONS ISOLATED TRANSDUCER ELEMENTS

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

This invention relates to hydrophone systems and deals more specifically with a fixed or towed array of hydrophone transducer elements provided in a unique assembly which provides for simpler fabrication, greater physical flexibility, and improved vibration isolation over prior art hydrophone assemblies.

(2) Statement of Prior Art

Prior art such as towed array hydrophone assemblies generally comprise a tubular housing in which a plurality of transducer elements are mounted. Typically, an acoustic coupling fluid is provided inside the tubular housing to provide buoyancy for isolating the various transducer elements. The elements are electrically connected to one another so that the transducer outputs can be provided to an electrical towing cable secured to an end cap associated with the tubular housing.

The prior art teaches that it is desirable to use a tubular housing so as to afford maximum transmission of the acoustic signals that the transducer elements are to detect, and to minimize noise.

The prior art also suggests that the transducer elements be mechanically connected, either to one another by way of mechanical couplings provided between the elements or that they be mounted to the tubular housing. See for example U.S. Pat. No. 4,862,428 issued Aug. 29, 1989 to Jackett et al and U.S. Pat. No. 4,679,179 issued Jul. 7, 1987 to Lally.

SUMMARY OF THE INVENTION

The purpose of the present invention is to provide an improved hydrophone assembly of simplified construction with greater physical flexibility, and with enhanced vibration isolation between the hydrophone/transducer elements and mounting structure while providing the means for mounting these elements in longitudinally spaced relationship generally used in a fixed array.

In accordance with the present invention a towed or fixed hydrophone array assembly is provided with longitudinally spaced hydrophone transducer elements electrically connected to one another in accordance with conventional practice. A cable is provided with electrical conductors so that the transducer elements may be electrically connected to the cable conductors and the cable has a conventional sheath which is secured to and may be received in a generally conically shaped front end portion of an elastomeric matrix in the shape of a cylinder, which matrix encapsulates all of the hydrophone transducer elements in the above mentioned longitudinally spaced relationship.

A metal annulus or ring is molded into the cable end of the elastomeric matrix material itself. This ring affords a convenient means for mounting the hydrophone assembly from a fixed support or other structure.

BRIEF DESCRIPTION OF THE DRAWING

A more complete understanding of the invention and many of the attendant advantages will be readily appreciated as the invention becomes better understood by reference to the following detailed description when considered in conjunction with the accompanying drawings wherein.

DESCRIPTION OF THE PREFERRED EMBODIMENT

Figure 1:
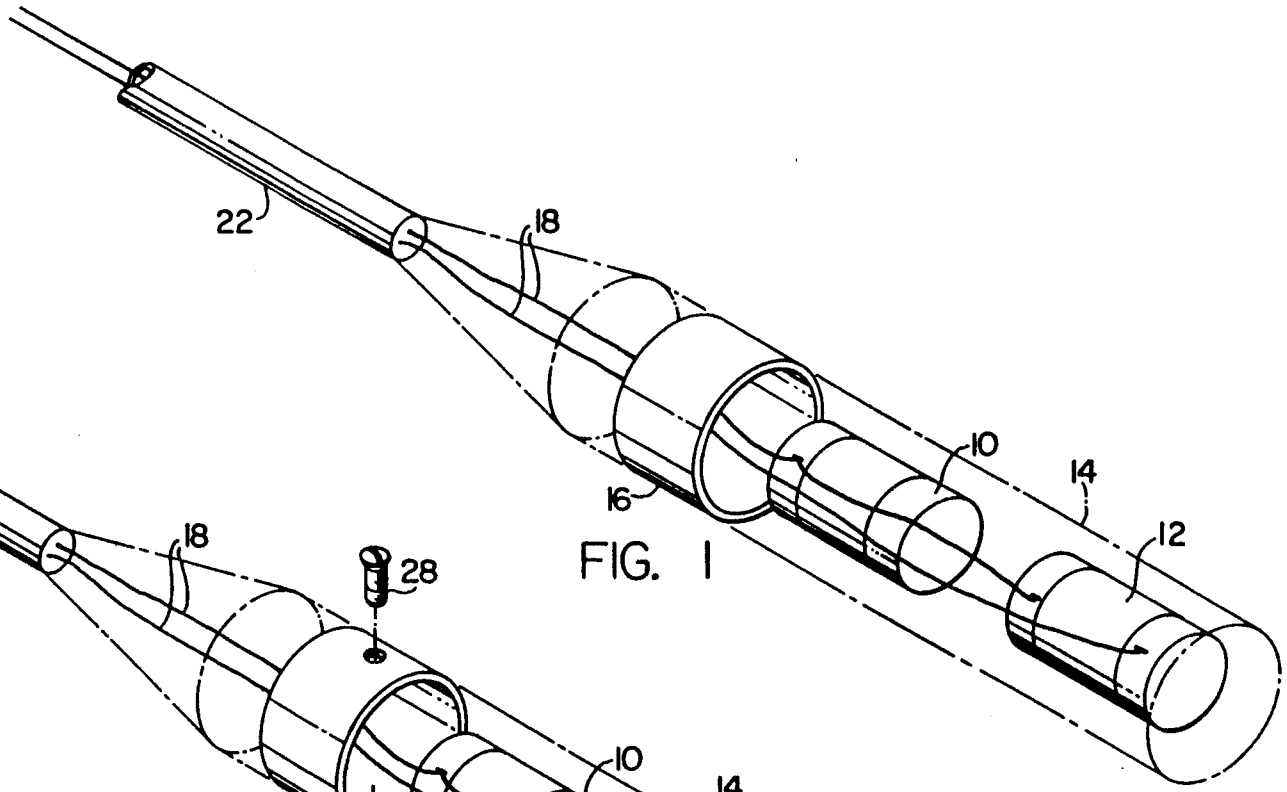
FIG. 1 is a perspective view of the overall configuration for an underwater hydrophone assembly including a plurality of longitudinally spaced transducer elements.

FIG. 1 illustrates a hydrophone assembly comprising longitudinally spaced hydrophone transducer elements 10 and 12 which elements are electrically connected to one another by wire segments and to electrical conductors 18 provided in an electrical cable 22.

In accordance with the present invention a molded cylindrical elastomeric matrix 14 is provided around these longitudinally spaced hydrophone transducer elements 10 and 12 such that the elements are maintained in the desired longitudinally spaced relationship relative to one another and such that these elements are mechanically isolated from one another by the matrix material 14.

As a result of supporting these elements 10 and 12 in the elastomeric matrix 14 no tubular housing or mounting shaft through these hydrophone transducer elements is required, and the elements themselves are mechanically unsupported other than by the matrix. Thus, the transducer elements are not mechanically coupled to one another except insofar as they are maintained in spaced relationship by the molded matrix material 14.

Figure 2:
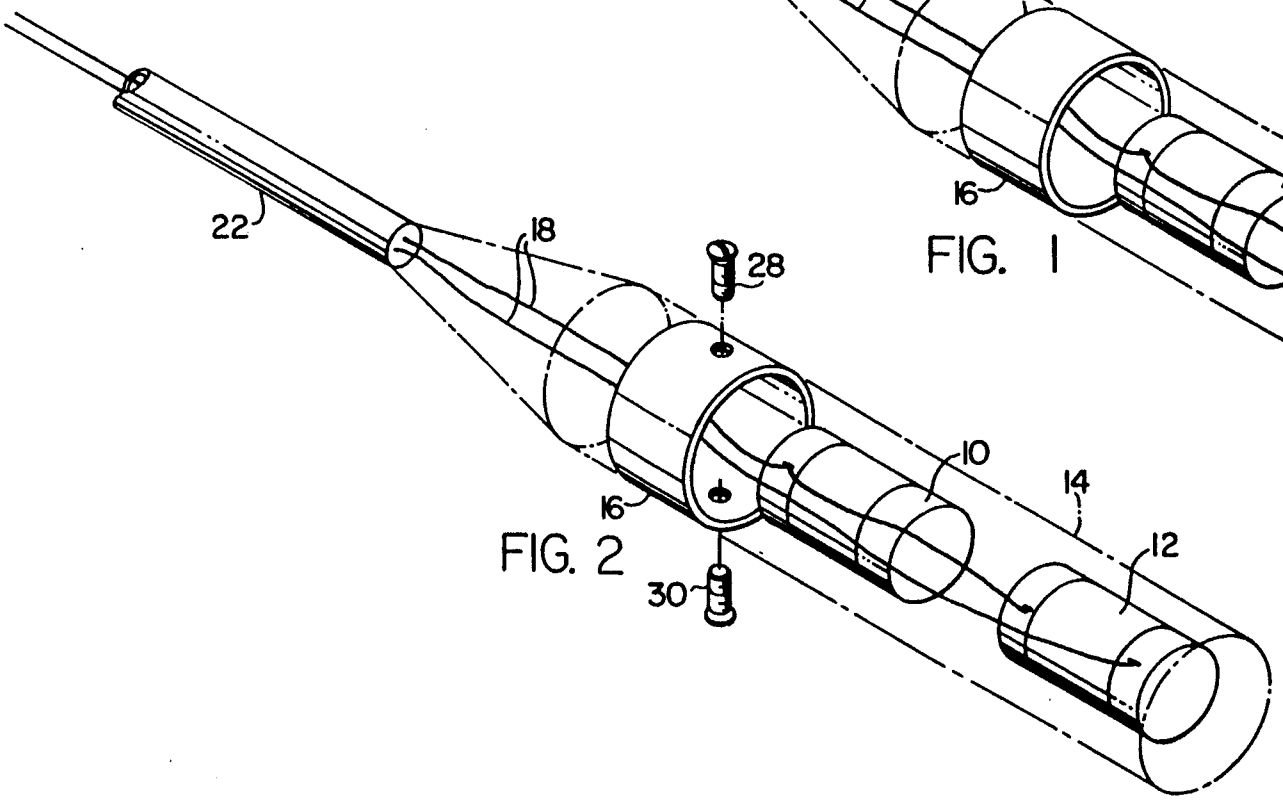
FIG. 2 is a view of the FIG. 1 assembly mounted in a support suitable for towing the hydrophone assembly.

In further accordance with the present invention an annular ring 16 is mechanically locked in the cylindrical molded matrix 14 and this ring 16 is utilized to support the hydrophone assembly from a fixed structure (not shown) by using screws 28 and 30 as shown in FIG. 2.

The molded elastomeric matrix material 14 preferably comprises a urethane material but other compounds may be used for the encapsulation of the hydrophone transducer elements according to the dictates of the environment for the hydrophone assembly itself.

In conclusion then, independent means is provided for mounting the hydrophone assembly and for providing the necessary electrical connections between the electrical cable 22 and the transducer elements themselves. As mentioned previously the annular metal rings 16 may be secured directly to a fixed structure such as the hull of a vessel. This system is simple in design and will preserve the spatial relationship between the transducers and will not produce any reflections, etc. Furthermore, with the arrangement shown in FIG. 2 the mechanical force required to tow the hydrophone array is completely independent of the electrical cable 22, the conductors associated with the cable indicated generally at 18 and except for the one-piece molded matrix 14 independent of the hydrophone transducer elements themselves 10 and 12.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. An underwater hydrophone assembly comprising longitudinally spaced hydrophone transducer elements, an electrical cable having electrical conductors, said transducer elements being electrically connected to said conductors, a generally cylindrical one-piece molded matrix encapsulating said longitudinally spaced hydrophone transducer elements and having one end molded to said electrical cable and defining adjacent said one end an annular groove, and a metal ring provided in said annular groove, said metal ring being mechanically connected to said transducer elements only by said matrix.

2. The combination according to claim 1 further characterized by screw means for coupling said hydrophone assembly to a towing cable fitting or the like.

3. The combination according to claim 1 wherein said matrix is molded from a urethane material.

4. The combination according to claim 3 wherein said metal ring is provided in the mold prior to providing the urethane material in the mold in order to mechanically lock said ring in said matrix.

* * * * *